United States Patent [19]

Johnson et al.

[11] Patent Number: 4,822,265

[45] Date of Patent: Apr. 18, 1989

[54] PUMP ROTOR

[75] Inventors: Paul R. Johnson, Kentwood; Kevin M. Wheeler, Plainfield Township, Kent County, both of Mich.

[73] Assignee: Dover Resources, Inc., Grand Rapids, Mich.

[21] Appl. No.: 180,608

[22] Filed: Apr. 5, 1988

Related U.S. Application Data

[63] Continuation of Ser. No. 894,605, Aug. 8, 1986, abandoned.

[51] Int. Cl.[4] ..... F04C 2/344; F04C 15/00

[52] U.S. Cl. ..... 418/182; 418/267

[58] Field of Search ..... 418/182, 266, 267

[56] References Cited

U.S. PATENT DOCUMENTS

| | | | |
|---|---|---|---|
| 813,018 | 2/1906 | Okun | 418/182 X |
| 851,962 | 4/1907 | Prossen | 418/267 X |
| 2,541,405 | 2/1951 | Chapman | 418/266 |
| 2,634,904 | 4/1953 | Clerc | 418/182 X |
| 3,054,357 | 9/1962 | McGill | 418/182 X |
| 3,700,363 | 10/1972 | Sorensen et al. . | |
| 3,820,924 | 6/1974 | Cassidy | 418/267 X |
| 3,955,905 | 5/1976 | Frommholz | 418/182 |
| 3,981,648 | 9/1976 | Jordan et al. | 418/267 X |
| 4,355,965 | 10/1982 | Lowther | 418/268 X |

FOREIGN PATENT DOCUMENTS

| | | | |
|---|---|---|---|
| 2150222 | 6/1985 | United Kingdom | 418/267 |

*Primary Examiner*—John J. Vrablik
*Assistant Examiner*—Eugene L. Szczecina, Jr.
*Attorney, Agent, or Firm*—Flynn, Thiel, Boutell & Tanis

[57] ABSTRACT

A rotary sliding vane fluid pump having an open rotor and radially extended arms forming slots that support the radially extending vanes. The relative position of the vanes and the inlet and discharge ports provide sealing by the vanes to the pump housing whereas the surface of the rotor does not seal to the pump housing so that radial rotor clearance is not critical. The rotor can be manufactured and assembled at lower cost. The rotor shape uses a minimum of material so that it is lower in weight and gives good pressure loading of the vanes. The open rotor is without closed voids to allow quick draining of the pump.

5 Claims, 3 Drawing Sheets

PUMP ROTOR

This application is a continuation of U.S. Ser. No. 894,605, filed Aug. 8, 1986, now abandoned.

FIELD OF THE INVENTION

This invention relates to an improved, rotary, positive displacement, sliding vane pump, particularly a low-speed hand pump.

BACKGROUND OF THE INVENTION

Rotary, positive displacement, sliding vane, power and hand pumps have been widely used. They are particularly useful for handling thin and viscous liquids. They are self-priming, for example, they prime themselves by pumping air and vapor at low speeds, such as on hand pump applications.

In some applications, it is desirable to empty the pump completely so that a different liquid can be handled with the same pump. This is a problem if there are any voids in the pump that do not drain quickly.

Most rotary sliding vane pumps seal at one point between the rotor and the housing. The rotor must be held in an exact location relative to the housing so that the liquid will not flow from the discharge back to the suction side of the pump. The pumps are more difficult and expensive to build because of the aforementioned seal and the close clearance required to effect it. Also, if any solids are present in the liquid, some will be caught in the small clearance space between the rotor and housing, leading to erratic operation and excessive wear.

Referring to FIG. 6, there is schematically illustrated a prior art sliding vane pump comprising a cylinder C having a closed end defined by an end wall E. A pump head (not shown) is fixable to the open end of the pump cylinder C and carries a bearing for rotatably supporting a rotor R. In the peripheral wall of the cylinder C are an opposed inlet port I and discharge port D. The inner peripheral wall of the pump cylinder C has the shape of an exact circle or a special cam shape. The rotor R is positioned in the cylinder C so that it nearly touches the inner wall of the cylinder C at the seal point P. This close clearance is desired so that a substantial amount of the fluid being pumped cannot pass the seal point P. In assembling the parts, the clearance is obtained by moving the rotor R with respect to the seal point P until the rotor just turns freely, then locking the rotor in position by securing the pump head that contains the bearing that controls the rotor position. This position is maintained for the life of the pump by pins (not shown) which are installed connecting the pump head with the pump cylinder C.

FIG. 7 schematically illustrates another prior art sliding vane pump. In this pump, the inlet port I and the discharge port D are circumferentially spaced from each other a distance such that a pair of the vanes V sealingly contacts the inner wall of the pump cylinder C between the discharge port D and the inlet port I. It is not necessary to maintain a close clearance between the rotor R and the inner wall of the pump cylinder C. However, it is necessary to position the leading edge of the discharge port D precisely with respect to the trailing edge of the inlet port I to avoid binding of the pump with a non-compressible fluid.

A disadvantage of these prior art sliding vane pump designs is that the rotors R are of circular design with an open center. This design traps in the rotor the fluid being pumped so that the pump cannot be drained quickly. It is desired that a pump be capable of being drained quickly so that the pump can be used to pump different fluids, for example, so that the same pump can be moved from one drum to another.

U.S. Pat. No. 3,700,363 discloses not a pump, but rather, a rotary sliding vane-type hydraulic motor in which the rotor has longitudinal grooves between the vane support flanges. The rotor is supported by bearings at its opposite axial ends so that it is rotatable about a fixed axis. There are many differences between pumps and motors even though, superficially speaking, a hydraulic motor can be considered to be a pump run backward. For example, the emphasis in pumps is on volumetric efficiency, whereas the emphasis in motors is on torque efficiency. Pumps operate in one direction in a given installation, whereas motors are required to reverse their direction of rotation. Because of these and related factors, a design that is completely acceptable in a hydraulic motor may operate poorly as a pump, and vice versa. Thus, the internal design features of hydraulic pumps and motors can be widely different from each other.

Figure 4:
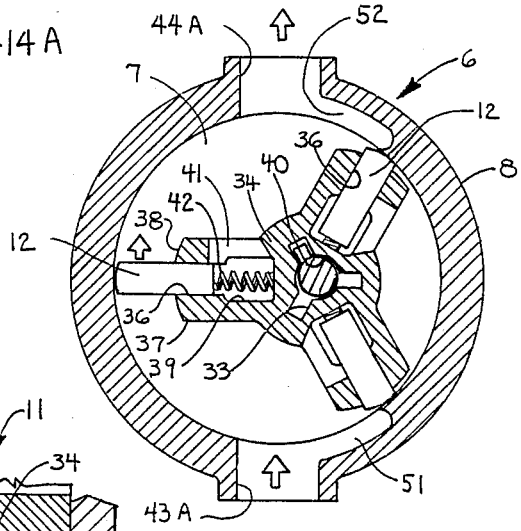
FIG. 4 is a view like FIG. 2 but looking in the opposite direction and showing a modification.
Figure 2:
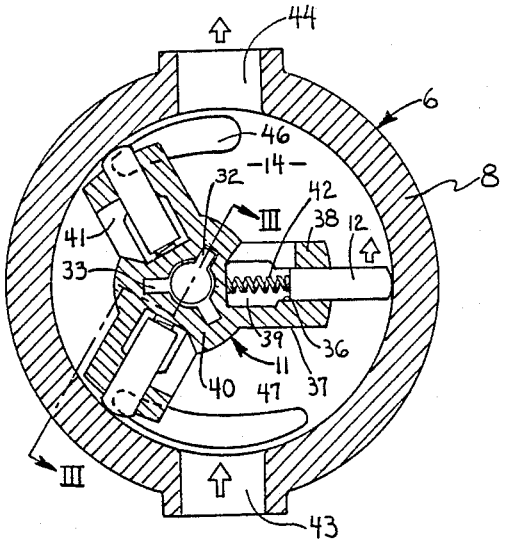
FIG. 2 is a stepped transverse sectional view through the pump cylinder and rotor of the hand pump of FIG. 1 taken substantially along the line II—II of FIG. 3.
Figure 5:
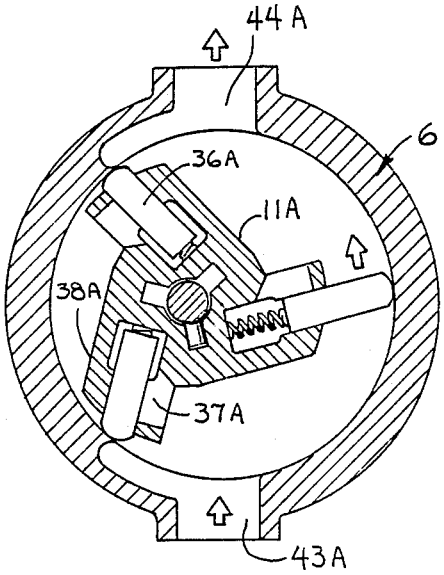
FIG. 5 is a view like FIG. 4 and showing another modification.
Figure 6:
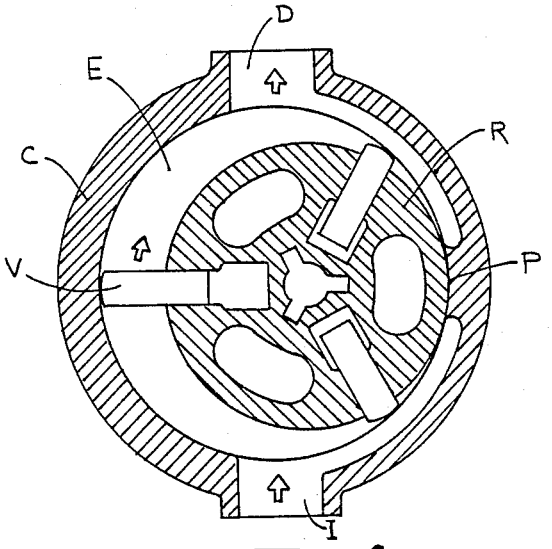
Fig. 6 PRIOR ART
FIG. 6 is a transverse section of a prior art rotary sliding vane pump.
Figure 7:
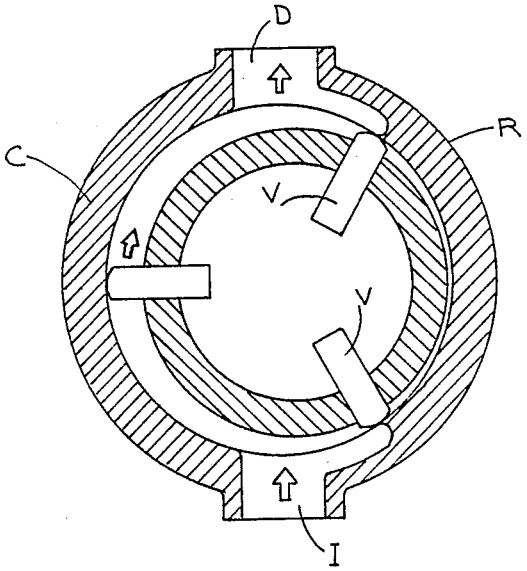
Fig. 7 PRIOR ART
FIG. 7 is as transverse section of a second prior art rotary sliding vane pump.

The direction of rotation of the rotor is counterclockwise in FIGS. 2 and 5 and is clockwise in FIGS. 4, 6, and 7. The direction of fluid flow is indicated by the arrows.

SUMMARY OF THE INVENTION

According to the invention, there is provided a rotary sliding vane pump, preferably a hand pump, comprising a pump cylinder having an inner wall defining a pump chamber and having an inlet and an outlet communicating with the pump chamber at circumferentially spaced-apart locations on the inner wall. A rotor is rotatably mounted in the pump chamber. The rotor has at least three pairs of parallel vane-guiding walls which define slots that are circumferentially spaced-apart at equal distances and extend outwardly from the central core of the rotor. The spaces between each pair of walls and the two pairs of walls on either side thereof are open and unobstructed whereby the inertia of the rotor is reduced and the rotor as a whole is of open configuration and is free of voids in which the fluid being pumped can accumulate. A drive shaft is drivingly connected to the rotor in such a manner that the rotor is free to move radially with respect to the drive shaft to a limited extent. A plurality of vanes are provided, each vane being disposed between the walls of one of the pairs of vane-guiding walls and being supported for sliding movement toward and away from the central core of the rotor so that the outer ends of the vanes can constantly slidingly and sealingly contact the inner wall of the pump cylinder. The axis of the shaft is so located with respect to the inner wall of the pump chamber that when the shaft is rotated, the rotor, the vanes and the inner wall of the pump cylinder define movable expansible and contractible pumping chambers effective to pump liquid from said inlet to said outlet. The shaft is rotatable by suitable means, such as a handle, so that the rotor can be rotated with respect to the pump cylinder. The rotor is supported, though not rigidly, at the drive end of the pump shaft and is constrained to run squarely within the pump cylinder by the pump head and the pump cylinder back wall.

DETAILED DESCRIPTION

Figure 1:
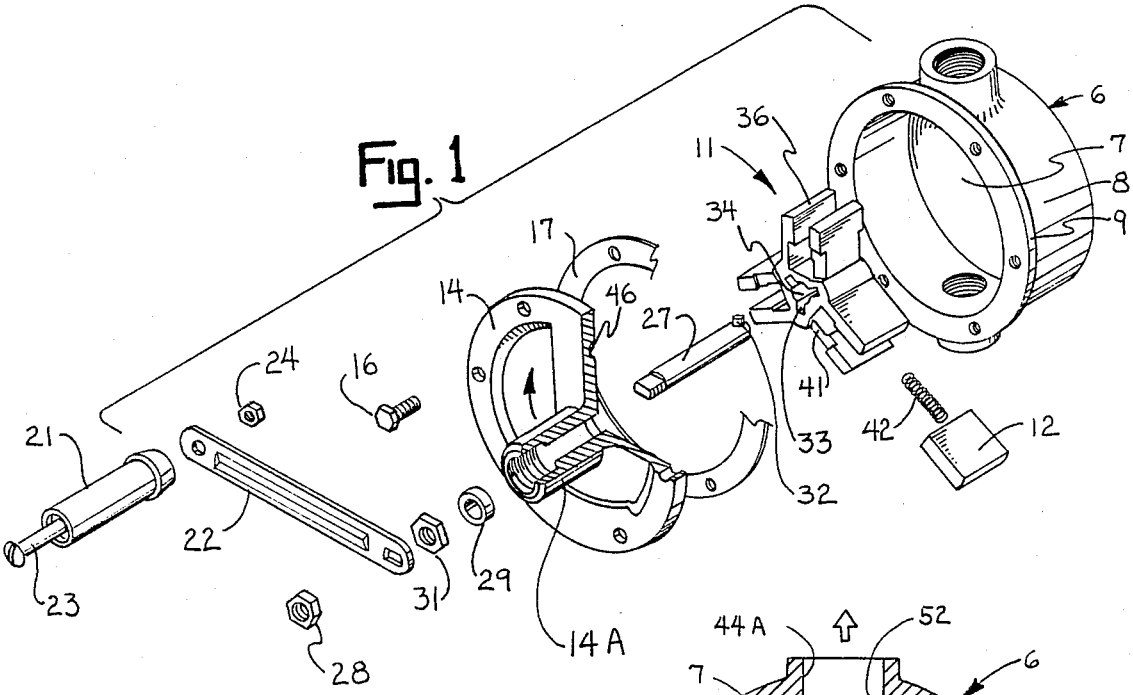
FIG. 1 is an exploded perspective view of a hand pump according to the present invention.

Referring to FIG. 1 and FIG. 2, there is illustrated a rotary positive displacement sliding vane pump comprising a pump cylinder 6 having an end wall 7, a peripheral sidewall 8 and an attaching flange 9 on the open side thereof remote from the end wall 7. A rotor 11 is disposed in the pump cylinder for rotation therein. The rotor 11 has at least three radially extending slots 36, a corresponding number of vanes 12 (only one of which is shown in FIG. 1) slidably receivable in the slots and a spring 42 for resiliently urging each of said vanes radially outwardly into sealing contact with the inner wall of the pump cylinder 6. A pump head 14 is secured in position to close the open side of the pump cylinder by cap screws 16, only one of which is shown in FIG. 1. A head gasket 17 is positioned between the pump head 14 and the pump cylinder 6 for conventional sealing purposes. A handle assembly comprises a handle 21 connected to a crank arm 22 by a handle pin 23 and nut 24. The pump head 14 has an eccentrically located boss 14A projecting therefrom away from the pump cylinder 6. The flatted left end of a shaft 27 projects through a central opening in the boss and a rectangular opening in the crank arm 22 and is secured to the crank arm 22 by a nut 28. The central opening in the boss 14A is enlarged at its left end and threaded at its extreme left end. A packing 29 and a packing nut 31 are sleeved on the shaft 27 and are received in the enlarged left end of the central opening in the boss 14A and secured therein whereby to seal the shaft against leakage. The shaft 27 extends into a central socket 34 in the rotor from which radiate grooves 33. The shaft 27 has a radially projecting drive pin 32 which is slidably receivable in one of the internal slots 33 in the rotor 11 whereby rotation of the shaft 27 by the handle 21 is effective to rotate the rotor.

The rotor 11 is not supported for rotation about a fixed axis by bearings in the pump cylinder 6 and the pump head 14. Rather, the rotor 11 is supported, though not rigidly, by the drive end of the pump shaft 27, and is drivingly engaged with the drive pin 32 so that the rotor can float radially inside the pump chamber to a limited extent. However, the rotor 11 is constrained to run squarely within the pump cylinder 6 by the pump head 14 and the back wall 7 of the pump cylinder 6. Further, the shaft 27 is not supported by the end wall 7 of the pump cylinder. Rather, the shaft 27 terminates within the rotor 11. The axis of rotation of the rotor 11 can float to a limited extent in the radial direction within the pump cylinder. However, the rotor 11 is in close, substantially sealing relationship with the inner surfaces of the base wall 7 of the pump cylinder and the opposing wall of the pump head 14.

Figure 3:
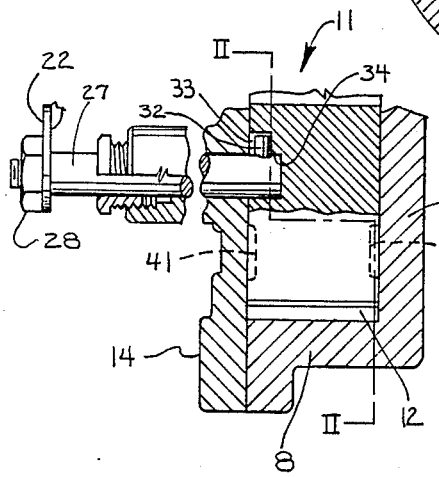
FIG. 3 is a fragmentary cross-sectional view substantially taken along the line III—III of FIG. 2 and partially broken away to show portions of the shaft.

Referring to FIG. 2, the rotor 11 has three or more radially extending slots 36, each slot retaining therein a vane 12 for radial sliding movement. The vanes 12 and slots 36 are equally circumferentially spaced apart from each other, for example, they are spaced 120° apart for the three-vane pump in the illustrated embodiment of the invention. Each slot 36 is circumferentially bounded by a pair of spaced, parallel, radially extending vane-guiding walls 37 and 38 which in turn define an enlarged cavity 39 at the radially inner end of the slot 36. A passage 41 extends from the cavity 39 through the leading wall 38 so that fluid can freely drain from the cavity 39 as the vane 12 moves in and out during rotation of the rotor. In the preferred embodiment shown in FIGS. 1–3, each leading wall 38 has a pair of such passages 41, in the form of a pair of notches in the opposite axial edges of such leading wall 38.

The walls 37 and 38 extend outwardly from a central core 40. The central core has the central socket 34 and slots 33 in which the shaft 27 and the drive pin 32 are received.

The vanes 12 are of plate-form structure and have an arcuate outer end wall for sealingly engaging the inner wall of the pump cylinder. One coil spring 42 is disposed between the radially inner end wall of the slot 36 and the radially inner end of the vane 12. The springs 42 constantly urge the vanes 12 radially outwardly toward the inner wall of the pump cylinder. During rotation of the rotor 11 the mechanical spring force is augmented by centrifugal force and by pressure of the fluid being pumped which enters the cavity 39 through the passages 41 as the vane moves from the inlet port toward the outlet port.

The inlet port 43 and the outlet port 44 are located in the peripheral sidewall 8 of the pump cylinder 6. A pair of arcuate grooves 46 and 47 are provided in the inner wall of the pump head 14 (FIG. 2) for communicating fluid from the inlet to the outlet and to define, in combination with the rotor and vanes, the pumping chamber. There is always one or more vanes 12 on each side of the rotor between the inlet and outlet ports. Since the vanes sealingly contact the inner wall of the pump cylinder 6, it is not necessary for the perimeter of the rotor 11 to be close to the inner wall of the pump cylinder. Rather, the spaces between the pairs of vane-guiding walls 37 and 38 are unobstructed, that is, the space between a leading vane-guiding wall 38 of one pair of walls and the trailing wall 37 of the preceding pair of walls is open and unobstructed. Thus, in the embodiment of the invention illustrated in FIGS. 1 and 2, the rotor 11 has a generally Y-shape. In designs employing four vanes, the rotor will have a cross shape and similarly for rotors having larger numbers of vanes.

FIG. 4 illustrates an alternate design in which, instead of using arcuate grooves 46 and 47 in the wall of the pump head 14, the inlet port 43A and outlet port 44B have circumferentially extending grooves 51 and 52 extending therefrom in the peripheral sidewall 8 of the pump cylinder.

FIG. 5 illustrates a modification in which the vane-guiding walls 37A and 38A of the rotor 11A defines slots 36A which extend tangent to an imaginary circle which is concentric with the axis of rotation of the rotor and is located within the central core 40 of the rotor.

The basic pumping operation of the sliding vane pump is conventional and does not need to be described in detail. Briefly, however, when the rotor is rotated, the vanes 12 slide in and out of the slots 36 and are maintained in constant contact with the inner wall of the pump cylinder 6. Each revolution of the rotor discharges a positive predetermined volume of the fluid being pumped through the outlet port 44.

The construction of the pump according to the present invention is simpler than in the prior art because of the simplified construction of the rotor and the simplified way in which it is mounted in the pump cylinder and is connected to the handle. The rotor can be made at lower cost and it is lower in weight than the rotors of the prior art as illustrated in FIGS. 6 and 7. Moreover, the rotor employed in the present invention has no voids and, therefore, it can be drained easily and quickly. Moreover, the pump according to the invention can easily handle liquids containing solids therein because it is not necessary to provide close tolerances in the radial direction and the rotor can shift radially as necessary to accommodate movement of small-sized solid particles.

The embodiments of the invention in which an exclusive property of privilege is claimed are defined as follows:

1. A rotary, sliding-vane pump, comprising:

a pump cylinder having an inner circumferential wall defining a chamber, means defining an inlet and an outlet communicating with said chamber at circumferentially spaced-apart locations and first and second transverse parallel end walls closing the opposite axial ends of said pump cylinder;

a rotor having an axis of rotation, said rotor being disposed in said chamber and having parallel opposite axial end walls slidably engaging said end walls of said cylinder so that said rotor can only rotate and move radially in said chamber, said rotor having a central core and at least three pairs of parallel, vane-guiding walls defining slots, which walls and slots extend substantially radially outwardly from said central core of said rotor, said slots being circumferentially spaced apart equal distances, the spaces between said pairs of walls being open and unobstructed, said central core having a blind-ended, centrally located socket coaxially with the axis of rotation of said rotor and which opens through one axial end wall of said rotor, said socket having a groove extending radially outwardly therefrom partway to the perimeter of said central core, the axial ends of said rotor being free from support by said pump cylinder so that said rotor is free to rotate and move radially relative to said pump cylinder;

a plurality of vanes corresponding in number to the number of said pairs of vane-guiding walls, each vane being disposed between the walls of one of said pairs of vane-guiding walls and supported for radially sliding movement relative to said rotor so that the radially outer ends of said vanes constantly contact said inner wall of said pump cylinder;

a rotatable shaft having an axis of rotation and extending through one of said end walls of said pump cylinder and extending into and terminating within said blind-ended socket of said rotor said blind-ended socket having a larger diameter than the diameter of the portion of said shaft that is received therewithin so that said rotor is free to move radially inwardly and outwardly with respect to said shaft to a limited extent, the portion of said shaft that is received within said socket having a single drive pin extending radially outwardly therefrom into said groove to drivingly interconnect said shaft and said rotor so that rotation of said shaft will rotate said rotor and said rotor will be free to move radially to a limited extent with respect to said shaft;

the axes of said rotor and said shaft being eccentric with respect to said pump chamber so that when said shaft is rotated, said rotor, said vanes and said pump cylinder form movable, expansible and contractible pumping chambers to pump liquid from said inlet to said outlet;

and drive means connected to said shaft and adapted for rotating said shaft and thereby rotating said rotor with respect to said pump cylinder.

2. A pump as claimed in claim 1 including a coil spring associated with each of said vanes for continuously urging it radially outwardly into sealing sliding contact with said inner cylinder wall.

3. A pump as claimed in claim 1 in which the slots are open at the opposite axial ends thereof and are closed at the inner ends thereof, said pairs of walls each define an enlarged chamber adjacent to the inner end thereof, the leading wall of each of said pairs of vane-guiding walls having a passage formed therein and extending from said chamber into the unobstructed space that is in front of said pair of walls, and a coil spring disposed between the closed inner end of said slot and the inner end of the vane in said slot for continuously urging the vane outwardly.

4. A pump as claimed in claim 1 in which the slots are open at the opposite axial ends thereof and are closed at the inner ends thereof, said pairs of walls each define an enlarged chamber adjacent to the inner end thereof, the leading wall of each of said pairs of vane-guiding walls having a passage formed therein and extending from said chamber into the unobstructed space that is in front of said pair of walls.

5. A pump as claimed in claim 4 in which said passage communicates with said chamber at a location adjacent to the outer periphery of said central core of said rotor.

* * * * *

UNITED STATES PATENT AND TRADEMARK OFFICE

CERTIFICATE OF CORRECTION

PATENT NO. : 4 822 265

DATED : April 18, 1989

INVENTOR(S) : Paul R. Johnson et al

It is certified that error appears in the above-identified patent and that said Letters Patent is hereby corrected as shown below:

Column 5, line 44; change "coaxially" to ---coaxial---.

Column 6, line 1; change "radially" to ---radial---.

Signed and Sealed this

Thirtieth Day of January, 1990

*Attest:*

JEFFREY M. SAMUELS

*Attesting Officer*

*Acting Commissioner of Patents and Trademarks*